US006142652A

United States Patent [19]

Richardson

[11] Patent Number: 6,142,652

[45] Date of Patent: Nov. 7, 2000

[54] COLOR FILTER MODULE FOR PROJECTED LIGHT

[76] Inventor: Brian Edward Richardson, 18675-K Adams Ct., Morgan Hill, Calif. 95037

[21] Appl. No.: 09/097,854

[22] Filed: Jun. 15, 1998

[51] Int. Cl.[7] ..... F21V 9/00

[52] U.S. Cl. ..... 362/280; 362/268; 362/293; 362/282; 362/308; 362/322

[58] Field of Search ..... 362/277, 280, 362/281, 282, 283, 284, 293, 319, 322, 323, 324, 308, 309, 268

[56] References Cited

U.S. PATENT DOCUMENTS 5,502,627 3/1996 Hunt et al. ..... 362/233
5,882,107 3/1999 Bornhorst et al. ..... 362/293

*Primary Examiner*—Thomas M. Sember
*Attorney, Agent, or Firm*—The Kline Law Firm

[57] ABSTRACT

A lighting module that projects various colors, hues, and intensities of light. The device includes a light source and a reflector to direct the light along an optic path. A primary optical element reduces the cross section of effected light regions as the light enters a filter assembly area in the optic path. Filters in the filter assembly are deployed in varying combinations and to varying degrees to produce the color, hue, and intensity of light desired by the user. The refracting action of the optical element allows the filters to be physically positioned in the optic path but to have no effect on the light until the filters are rotated so that filter segments align with optical segments, and the filter changes the light being projected from the lighting module.

20 Claims, 18 Drawing Sheets

COLOR FILTER MODULE FOR PROJECTED LIGHT

FIELD OF THE INVENTION

This invention relates generally to entertainment and architectural lighting, and more specifically is a device to control the hue, saturation, and brightness of color emanating from a lighting module.

BACKGROUND OF THE INVENTION

Colored light sources are often used in the theater, television, touring productions, and architectural applications. The color is varied in hue, saturation, and intensity to obtain a particular artistic effect. The artistic requirements might be that the color remain static, or that it change over time. Cost, speed of changing colors, the quantity of colors produced, the smoothness of color changing, compact size and weight, and the efficiency of transmitting light through color filters are all factors in the practical usage of a color changing system.

One prior art method of changing the color of a light source is to manually insert a specific color filter in the light's path to obtain a specific artistic result. This method required that the filter be changed if it did not result in the exact color that was desired. Changing a color filter required the procurement of the new color filter and the replacement of the old filter. This use of specific filters makes it impractical to change the color of the light during a performance. The filters most often used in these applications are dyed or coated plastic films called gel. The durability of this material is limited and requires frequent replacement when used with a high powered light source. The general efficiency of light transmission is low. In the creation of certain dark blue and red colors, transmission can be as low as 2%.

Since the introduction of the use of gel as a color filter, inventors have created several methods to remotely change the color of a light source utilizing gel. The Scroller$^{tm}$, by Wybron of Colorado Springs, CO, assembles a plurality of different colored gels into a band that is fitted around a pair of scrolls. The scrolls are spaced on opposite sides of the light source's aperture. By rolling the scrolls, any of the colors on them can be accessed. This method and its variations, embodied in products manufactured by a number of companies, is a compact solution to changing color. However, the method has many deficiencies. The mechanism to locate and control the scrolls is costly and complex. Gel deteriorates in a short time when rolled back and forth on a scroll while being subjected to heat from a light source. Furthermore, the number of different colors that can be used at one time is limited to the number of colors that are able to be assembled into a single gel band. The slow speed of color changing, the low transmission efficiency of the filter material, and the need to frequently replace gel filter material are also deficiencies in this prior art method.

U.S. Pat. No. 5,126,886, to the present inventor Richardson, discloses an improved scroll type gel color changer. Yellow, cyan, and magenta scrolls of varying color saturation are located in series in the optic path. The various position locations of the three scrolls result in an unlimited number of colors. Colors can be changed quickly or slowly. The transition from one color to another is smooth. The mechanism of this color changing system has three times the complexity of the single scroll system and therefore suffers in cost and reliability.

Other inventors have created several other methods to change the color of a light source utilizing interference or dichroic type filters. Dichroic filters are efficient in transmitting light and are durable, but they are costly. U.S. Pat. No. 5,073,847, to Bornhorst, issued Dec. 17, 1991, and U.S. Pat. No. 5,186,536, to Bornhorst, et al., issued Feb. 16, 1993, disclose a method of tilting a series of dichroic color filters to create various colors. However, this system is limited in the quantity of colors that it creates, the excessive cost of the color filters, and the fact that the system requires a very complex control mechanism.

U.S. Pat. No. 4,914,556, to the present inventor Richardson, issued Jun. 30, 1992, discloses an assembly of yellow, cyan, and magenta filter wheels, each with varying levels of color saturation. The positioning of the wheels between a light source and an aperture determines saturation and hue of color at the aperture. This module creates an unlimited quantity of colors, however at a relatively high cost. The filters of this module must be many times greater in size than the aperture. This results in a very high cost to aperture size ratio.

Accordingly, it is an object of the present invention to provide a compact and simple, and therefore reliable, light color control mechanism that is inexpensive to produce and maintain.

It is a further object of the present invention to provide a device that, given a white light source, can emit any color chosen by a user. The device can also change from one color to any other color quickly and smoothly.

It is a still further object of the present invention to provide a device that efficiently transmits light.

SUMMARY OF THE INVENTION

The present invention is a lighting module that projects various colors, hues, and intensities of light. The device includes a light source and a reflector to direct the light along an optic path. A primary lens element reduces the cross section of effected light regions as the light enters a filter assembly area in the optic path. Filters in the filter assembly are deployed in varying combinations and to varying degrees to produce the color, hue, and intensity of light desired by the user. The refracting action of the lens segments allows the filters to be physically positioned in the optic path but to have no effect on the light until the filters are rotated so that filter element segments align with lens segments, and the filter changes the light being projected from the lighting module.

An advantage of the present invention is that it provides a single, compact unit that allows the user to project any color, hue, or intensity of light desired. This eliminates the need for multiple pieces of equipment.

Another advantage of the present invention is that it is simple and inexpensive to manufacture and is therefore reliable and easy to maintain.

Still another advantage of the present invention is that effect of the lens segments allow the filters to be installed in the optic path, the filters having no effect when in a non-deployed position.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
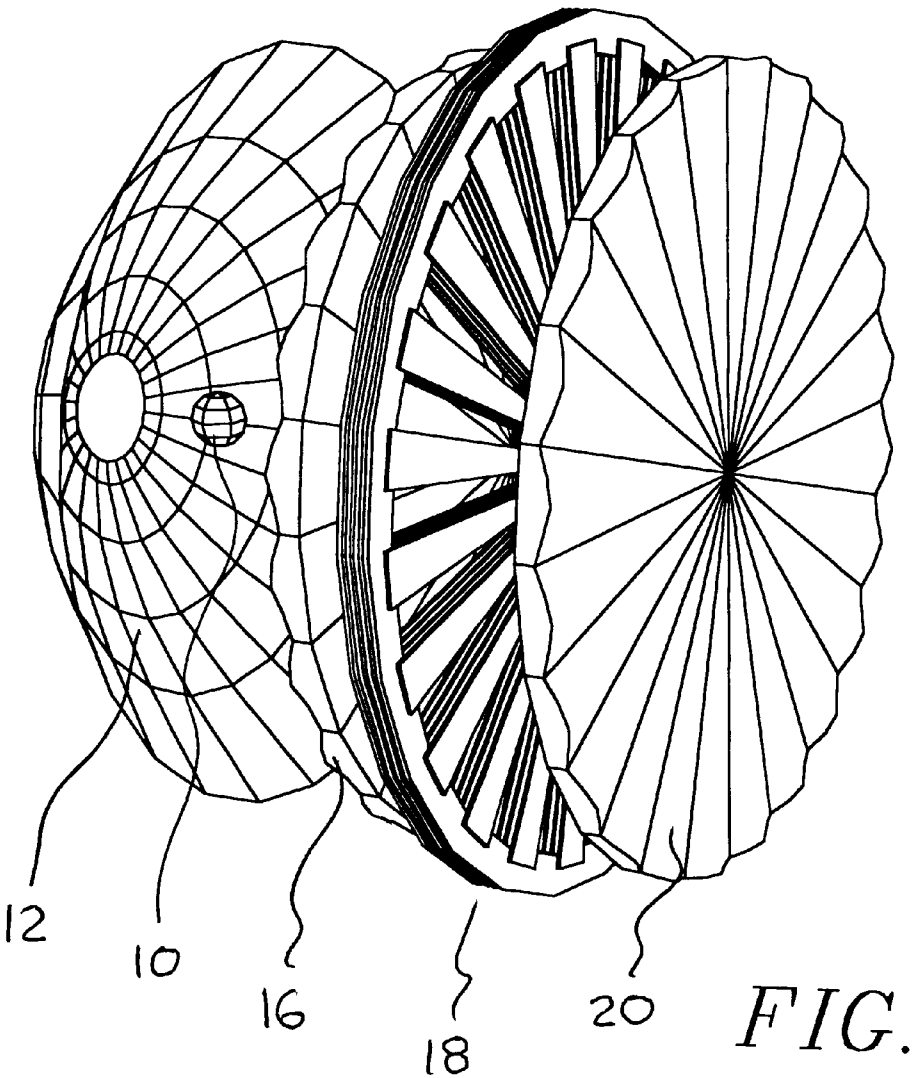
FIG. 1 shows a prospective view of the color system and an accompanying light source.
Figure 2:
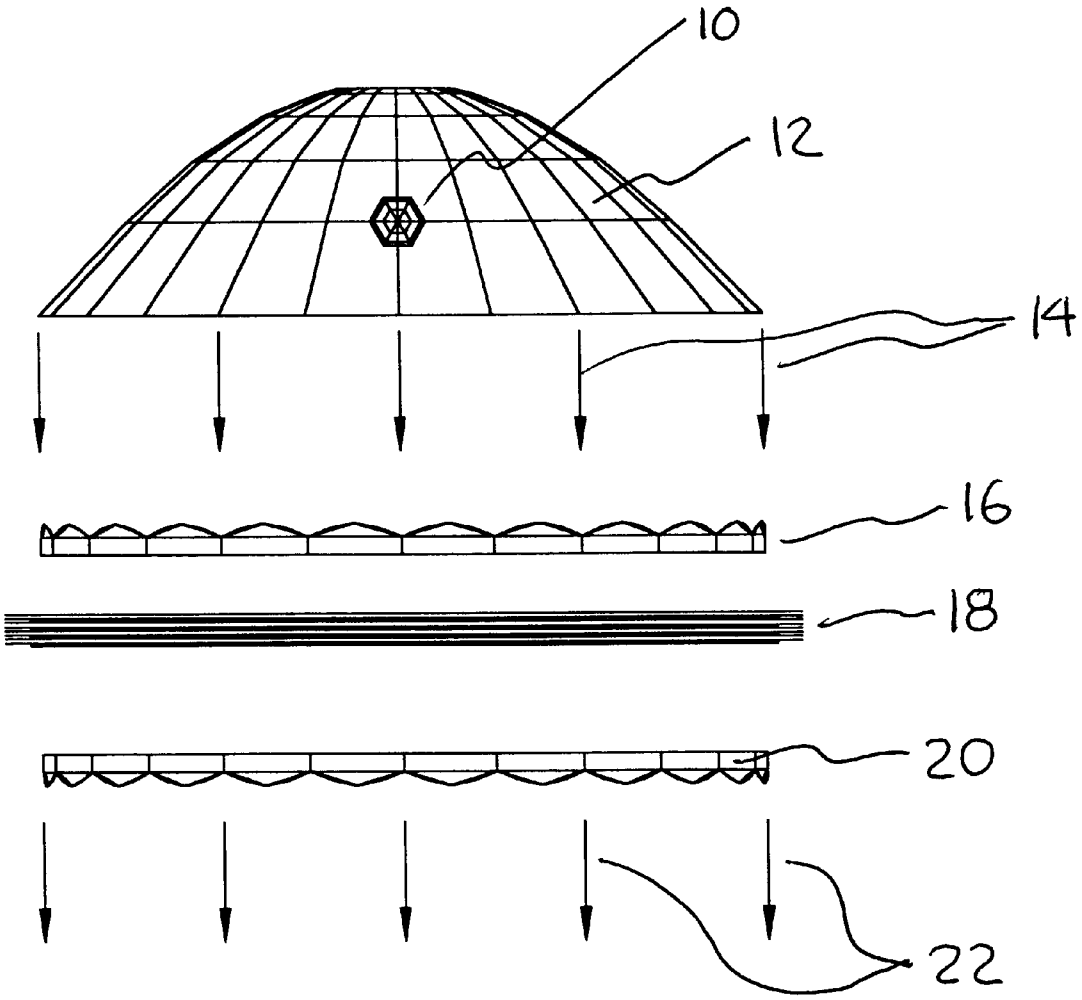
FIG. 2 shows a plan view and the relationship of the various key components.

The present invention is a color filter module used in conjunction with a light source as is illustrated in FIGS. 1 and 2. Referring first to FIG. 1, a light source 10 is shown for reference in describing the operation of the system. The source may be of any type or size, and would be known by persons knowledgeable in the art. The light source 10 is located within a reflector 12. The reflector 12, as is the case with the light source 10, may be of any common type or size. A parabolic reflector is depicted in the drawings. Any light source that generates generally parallel light, such as a light source with a condenser lens, can also be used in the module. These light sources are well known to those skilled in the art.

Inbound light rays 14 (see FIG. 2) emanate from the reflector 12 in substantially parallel paths along an optical path including a primary optical element 16, a color filter assembly 18, and a secondary optical element 20. The light rays exit the secondary optical element 20 as outbound light rays 22.

Figure 3A:
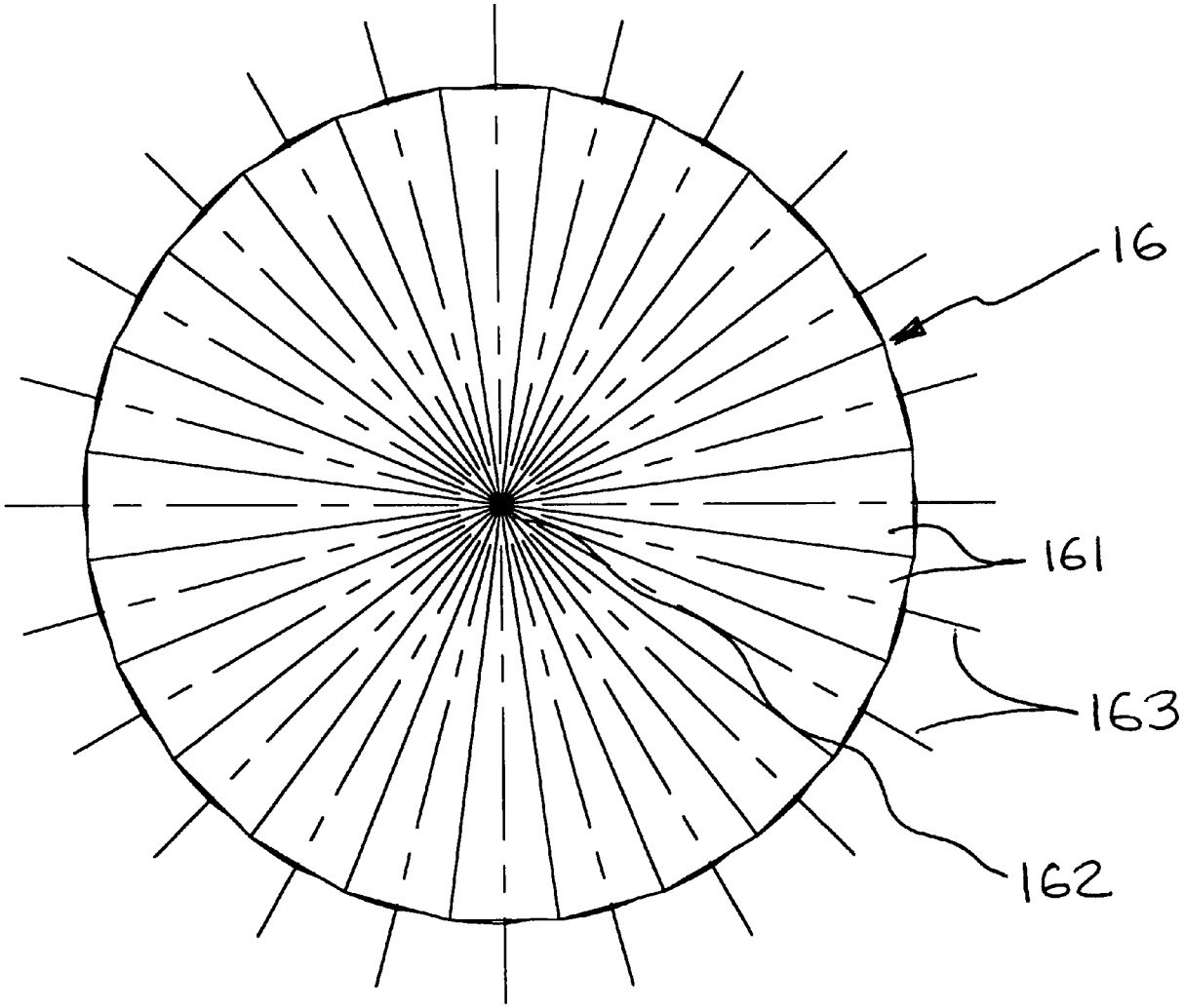
FIG. 3A shows a detail view of the primary optical element as viewed along the optical path axis.
Figure 3B:
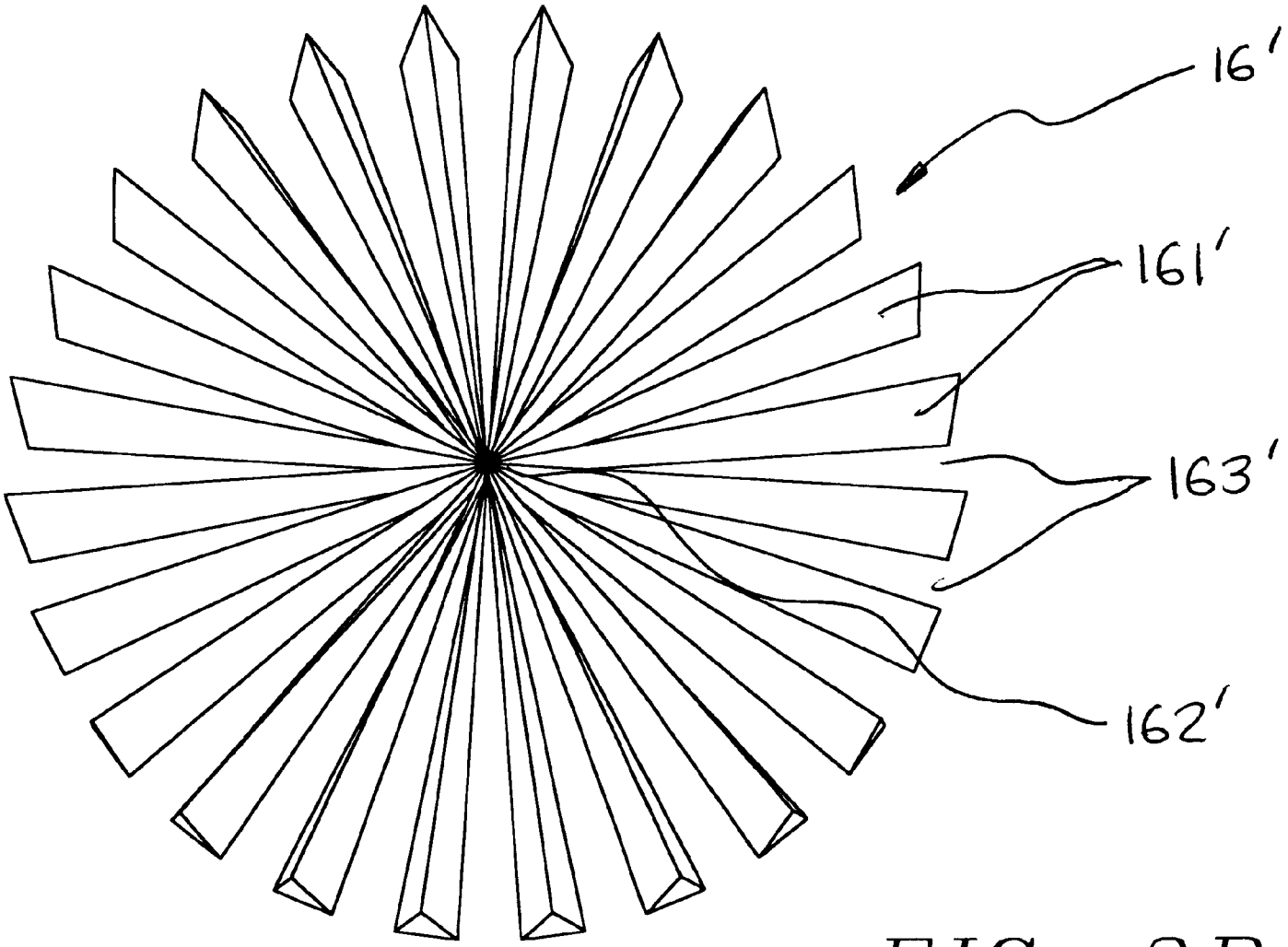
FIG. 3B shows a perspective detail view of an alternate primary optical element.
Figure 3C:
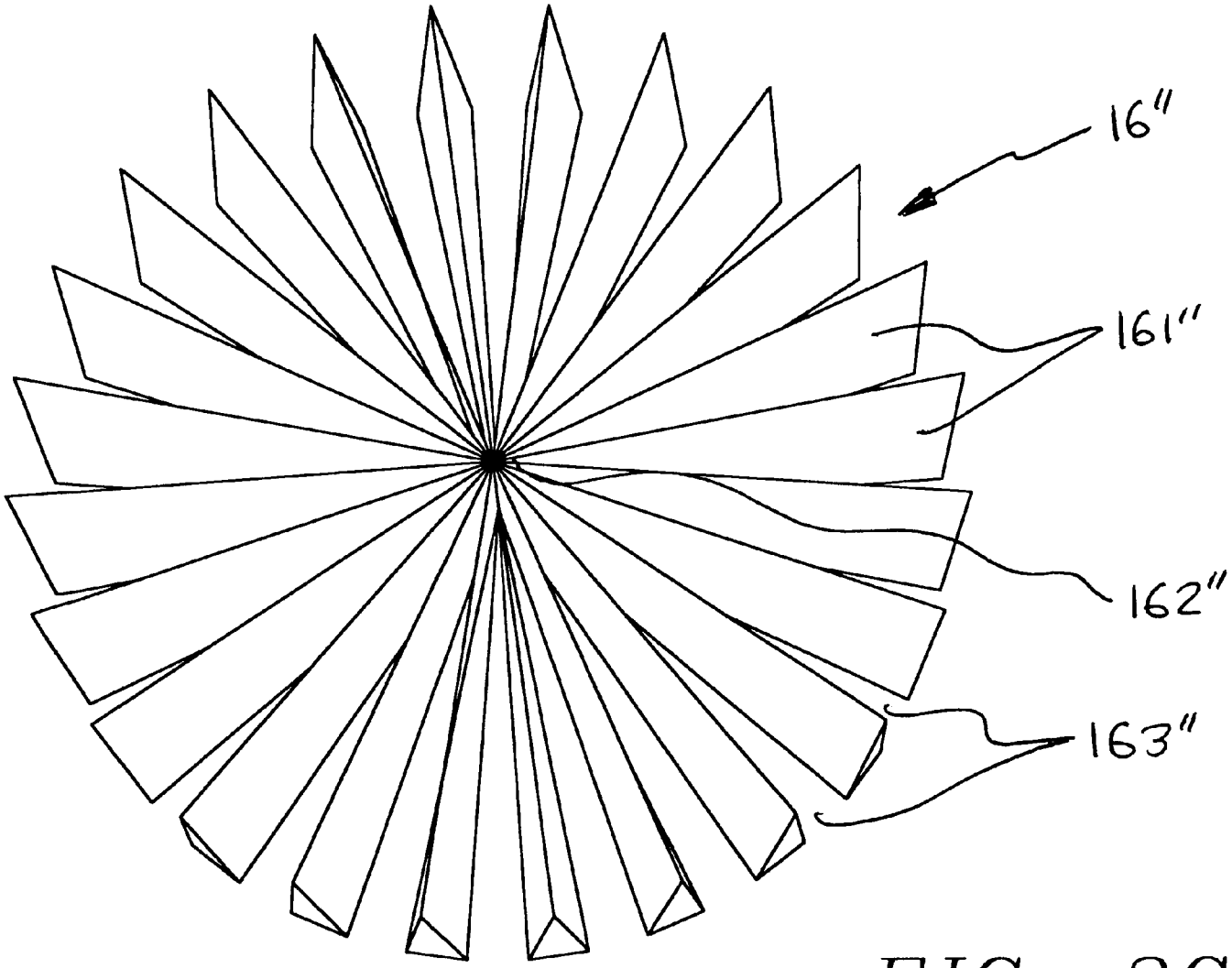
FIG. 3C shows a perspective detail view of another alternate primary optical element.

A primary optical element 16 is shown in detail in FIG. 3A, as viewed in its position along the optical path longitudinal axis. In the preferred embodiment of the invention, the primary optical element 16 is comprised of twenty-four identical lens segments 161. The lens segments 161 are wedge shaped, and they are positioned adjacent to one another radially around a center 162 of the primary optical element 16. A focal line 163 of each lens segment 161 originates at the center 162 of the optical element 16, and emanates outward along a longitudinal center of the lens 161. The primary optical element 16 is preferably a unitary element formed from a solid piece of material, typically by a molding process. FIGS. 3B and 3C show alternate constructions for the primary optical elements.

Figure 4A:
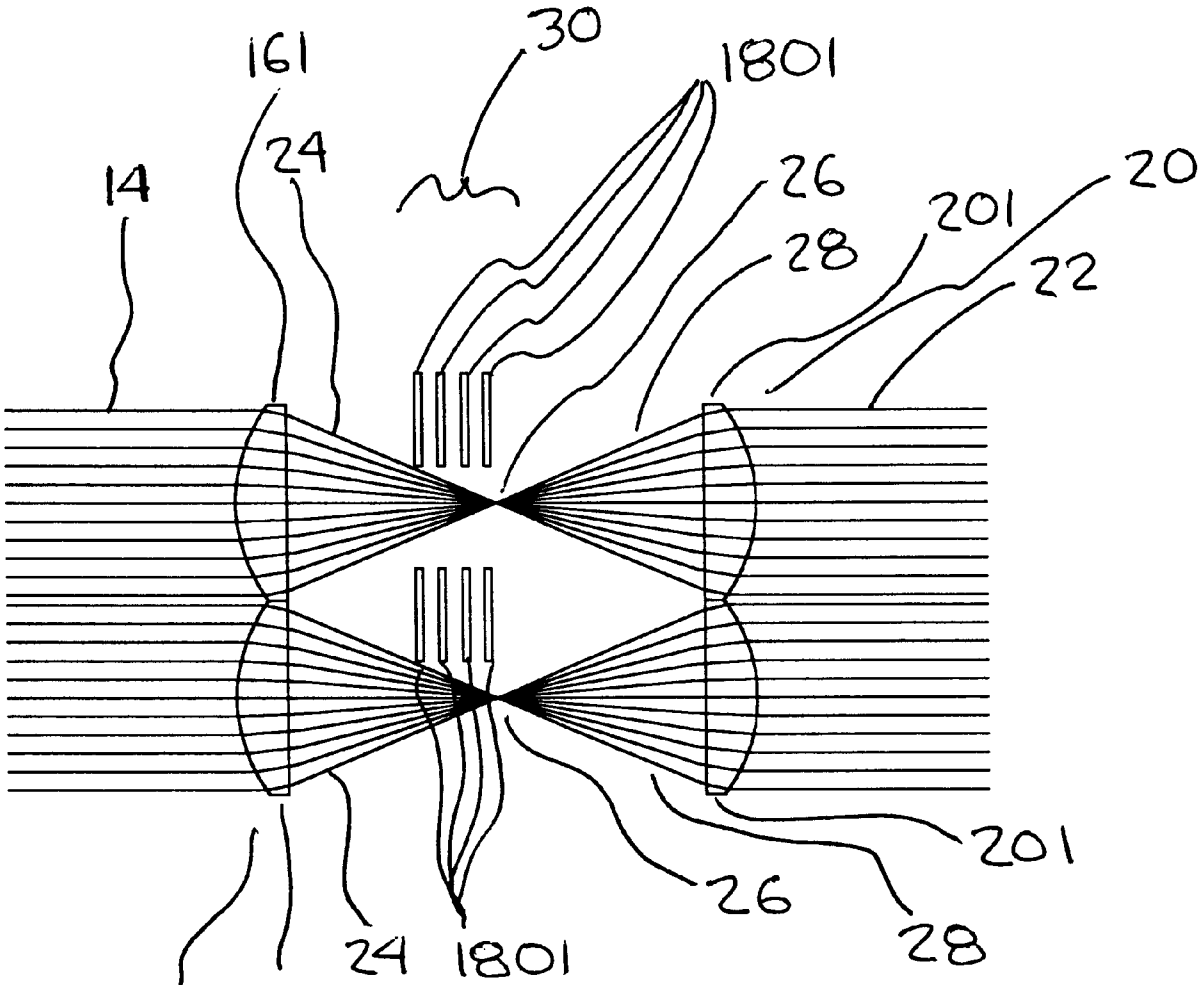
FIG. 4A shows a segment of the optical ray trace of the system with two refractive optical elements.

FIG. 4A is a ray trace that shows a side view of a pair of typical lens segments 161. Shown are the inbound light rays 14 entering from the left and striking the lens segments 161. Refracted light rays 24 exit the lens 161 and converge at focal point 26. All the focal points 26 lie on the corresponding focal lines 163 of the lens segments 161. The light rays then become divergent light rays 28 as they exit the focal point 26 and strike a lens segment 201 of the secondary optical element 20. The secondary optical element 20 is shown to be identical to the primary optical element 16, and is mirrored with the primary optical element 16 around the focal points 26. The secondary optical element 20 collimates the light beam so that it is again generally parallel light.

The secondary optical element 20 may in fact be different from the primary optical element 16. This difference would depend on the specific application of the filter assembly. If a user did not require generally parallel light, he could eliminate the secondary optical element altogether, which would result in a more diffuse light beam. This situation is illustrated in FIG. 4D.

The outbound light rays 22 emanate from the secondary lens segment 201, again with paths essentially parallel to the optic path axis. The type of optical elements shown herein are of the simple non-symmetric biconvex type, but many other types may be employed to obtain the desired results. A person knowledgeable in the art of optics could devise an endless number of optical elements to obtain the desired result of a reduction of the cross section and/or redirection of the light rays.

Figure 4B:
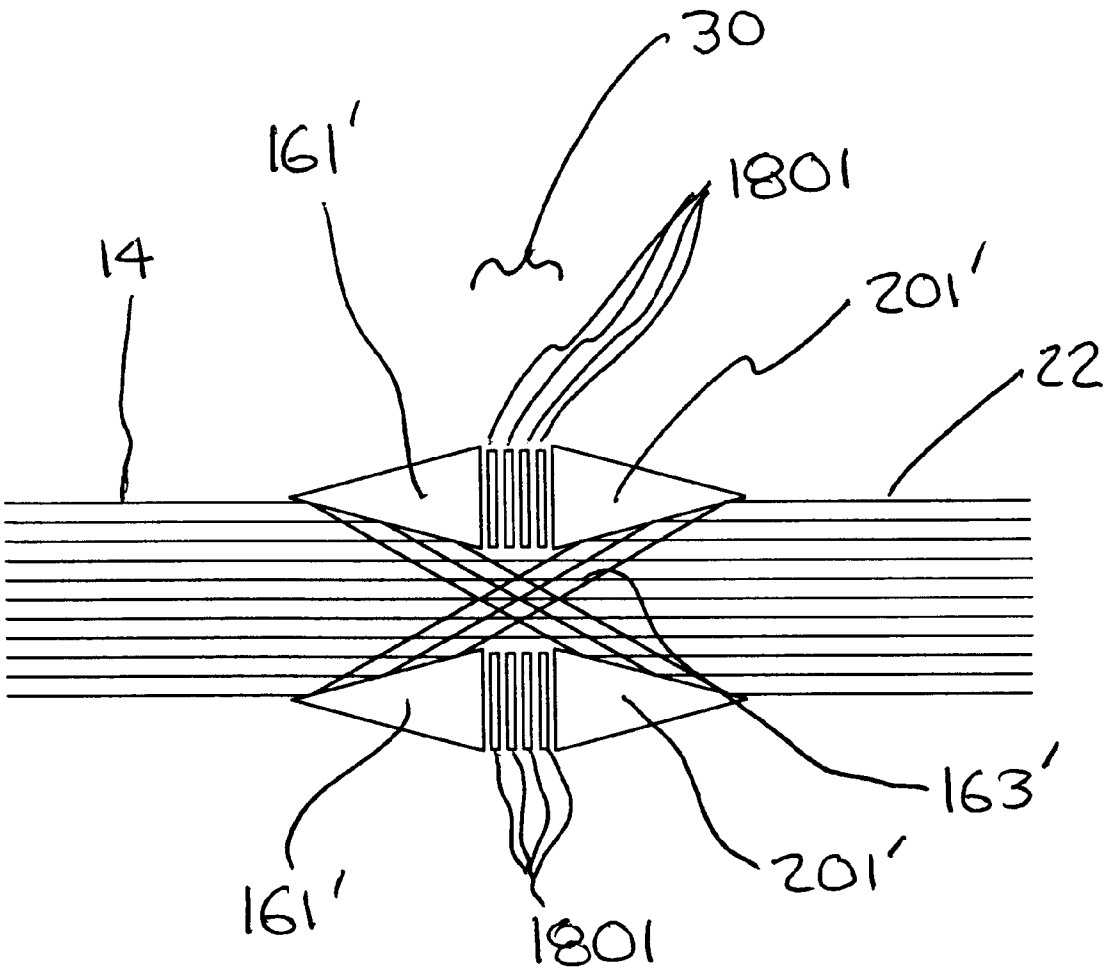
FIG. 4B shows a segment of the optical ray trace of an alternate system with two reflective optical elements.

A first alternate embodiment of the optical element of the present invention is shown in FIGS. 3B and 4B. FIG. 3B shows a perspective view of a reflective optical element. Reflective segments 161' emanate from the center 162' of the primary optical element 16'. The widths of the open segments 163' are equal to or less than the angular width of the reflective segments 161'. In FIG. 3B, the open segments 163' are shown as being of equal width compared to the reflective segments 161'. The reflective segments 161' are equally spaced around the center 162' of the element 16' with the open spaces 163' separating the reflective segments 161'.

FIG. 4B is a ray trace that shows a side view of the operation of the first alternate embodiment of the device. Inbound light rays 14 pass unobstructed through the open segments 163' of the primary reflective optical element 16'. (Two reflective segments 161' are shown.) The light rays also pass unobstructed through equivalent openings in a secondary reflective optical element 20'. The secondary reflective optical element 20' is equivalent to the primary element 16' except that the secondary element 20' is oriented in the opposing direction along the axis of the optical path. As with the first preferred embodiment, the secondary element 20' may have a different configuration from the primary element 16', depending on the requirements of the specific application.

Inbound light rays 14 reflect off a reflective surface 161' of the primary reflective optical element 16'. The upper inbound light rays 14 reflect across an open space between a lower surface of an upper reflective segment 161' of the primary reflective element 16' and an upper surface of a lower reflective segment 201' of the secondary reflective element 20'. The lower inbound light rays 14 reflect off an upper surface of a lower primary reflective segment 161', across the open space, and reflect off a lower surface of an upper secondary reflective segment 201'. The secondary reflective surfaces 201' are parallel to the primary reflective surfaces 161'; therefore the outbound light rays 22 propagate to paths parallel to those of the inbound light rays 14. It should be noted that some of the light rays pass through the open space unaffected by the optical elements. It should also be noted that the light rays before and after the optical elements are parallel in direction but rearranged in location; that is, upper inbound rays end up being lower outbound rays, and vice versa.

Figure 4C:
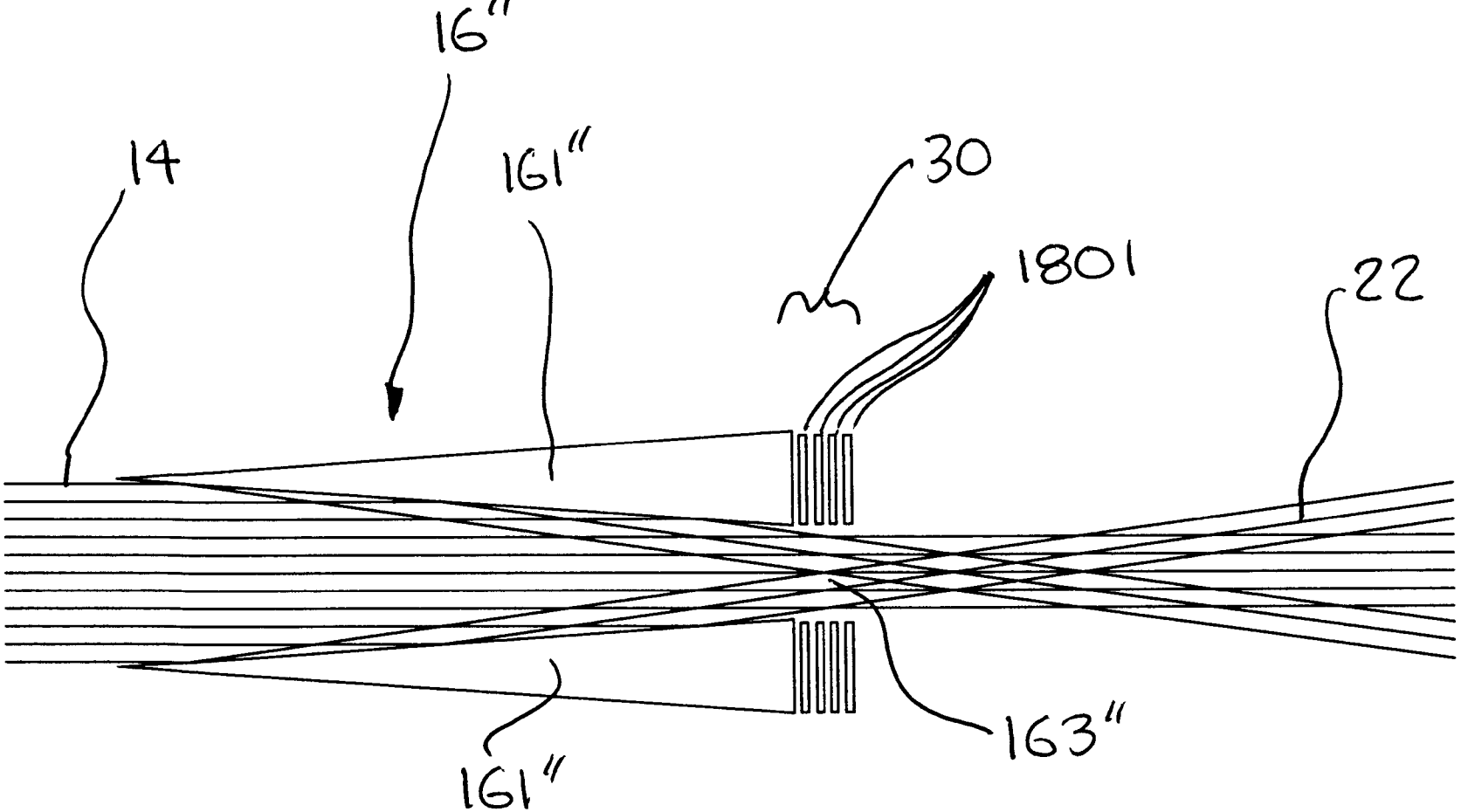
FIG. 4C shows a segment of the optical ray trace of another alternate system with one reflective optical element.
Figure 4D:
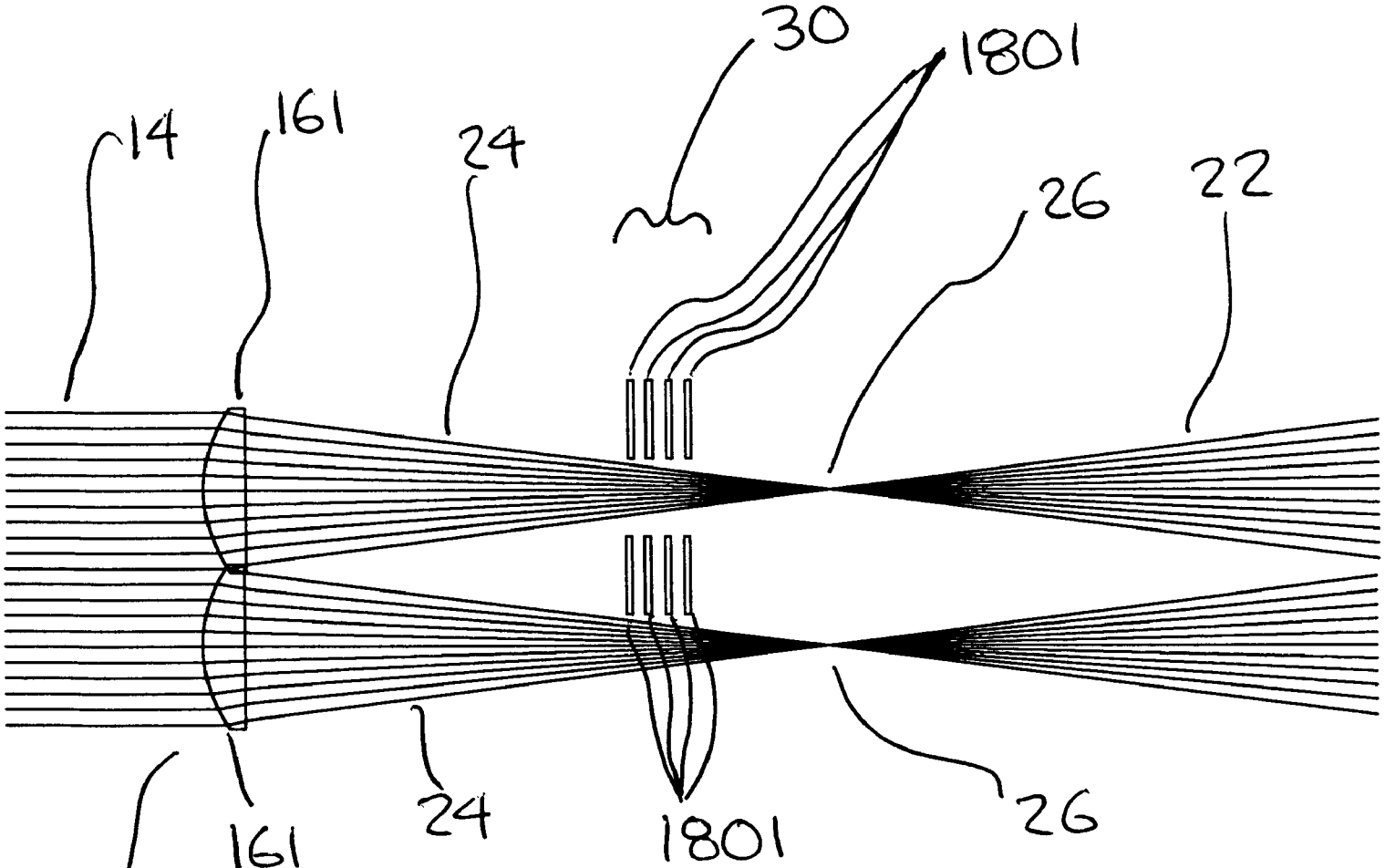
FIG. 4D shows a segment of the optical ray trace of a system with one refractive optical element.

A second alternate embodiment is shown in FIGS. 3C and 4C. FIG. 3C shows an optical element 16" similar to the first alternate embodiment, optical element 16'. However, optical element 16" has individual reflective segments 161 " that are taller than those of optical element 16'. As in the first alternate embodiment, the reflective segments 161" are separated by open spaces 163" and are radially located about the center 162" of the optical element 16".

FIG. 4C is a ray trace that shows a side view of the operation of two reflective segments 161" of the primary optical element 16". Again, some central inbound light rays 14 pass unobstructed through the open space between a lower surface of an upper reflective segment and an upper surface of a lower reflective segment 161". Upper inbound light rays 14 reflect off a lower surface of the upper reflective segment 161" of the reflective element 16". Lower inbound light rays 14 reflect off an upper surface of the lower reflective segment 161". The narrow angle of divergence provided by the taller reflective segments 161" may be desirable in some lighting applications.

Both of the alternate embodiments shown use reflective elements as opposed to the refractive elements of the first preferred embodiment. In any embodiment using reflective elements, the amount of divergence of the light can be varied by changing the angle of the reflective surfaces to best fit the particular application. Modifications or imperfections in these reflective elements therefore have a more significant effect on the light path than similar changes in the refractive elements. Since the angle of reflection is equal to the angle of incidence, a 1° change in the angle of the reflective segment leads to a 2° change in the light path.

Each of the embodiments of the primary optical element 16, 16', 16" of the present invention include lens or reflective segments 161, 161', 161" that reduce the cross sectional area of an effected light region by at least one half. The structure of the primary optical elements, the utilizing of a plurality of segments within the lens, makes it possible for optical filters or other optical elements to be installed in the optic path while having no effect on the light until the filter or other elements are deployed. Once deployed, the filters change the projected light's properties.

Figure 1A:
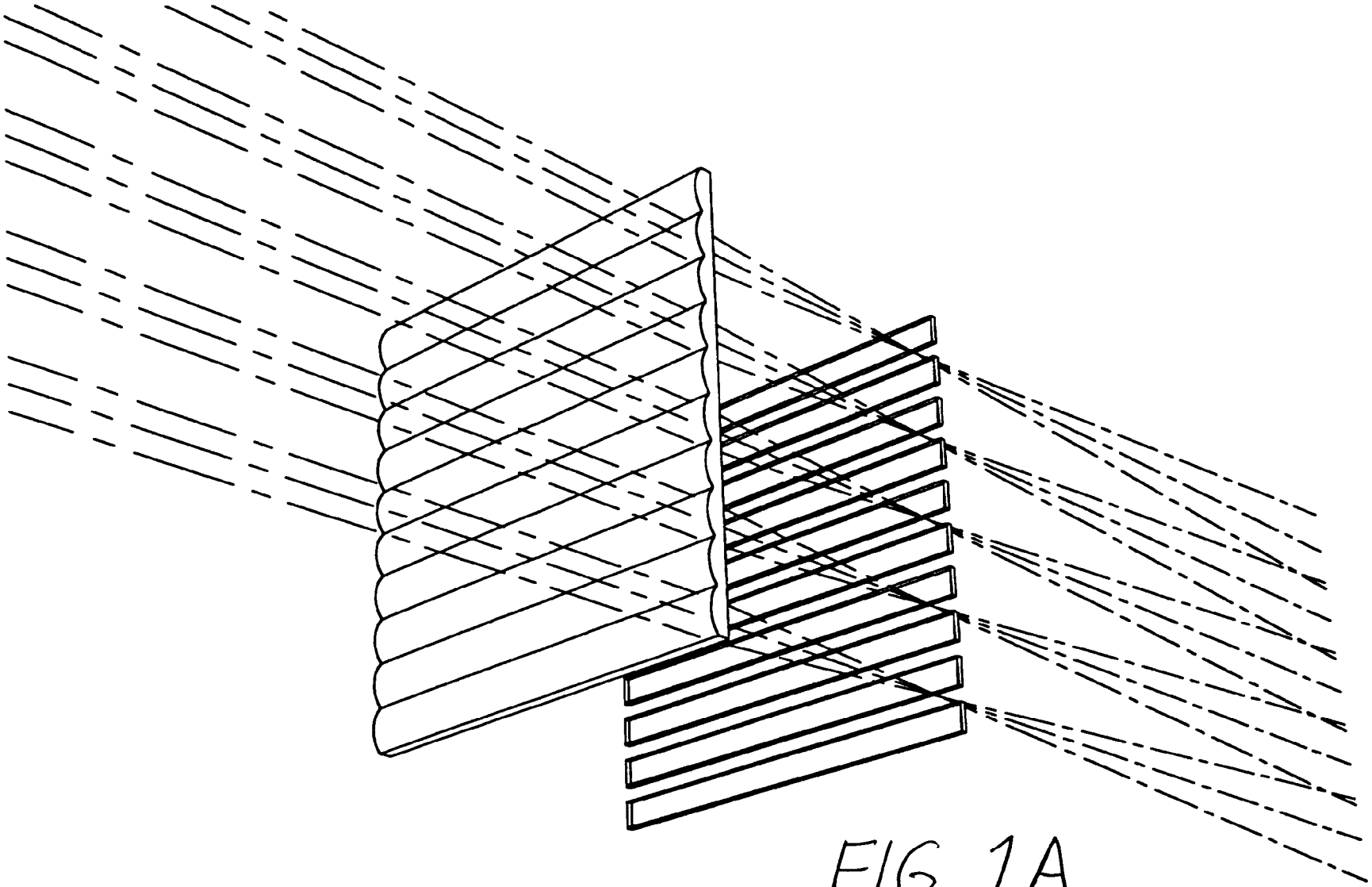
FIG. 1A shows a linear array system.
Figure 1B:
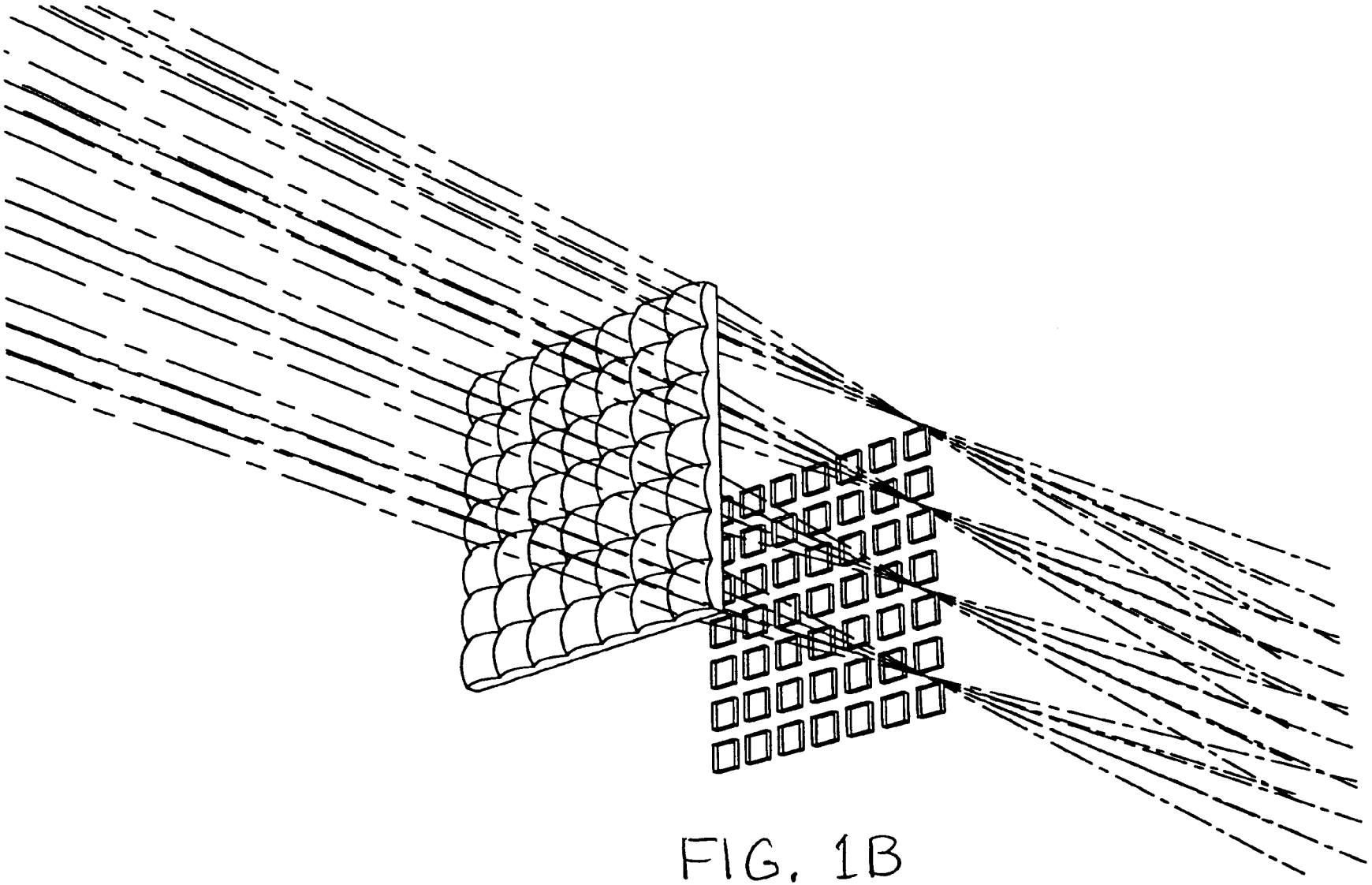
FIG. 1B shows a matrix array system.

The optical elements are depicted in the drawings as radial arrays, but could just as easily be constructed as linear or matrix arrays of optical segments, as is illustrated in FIGS. 1A–B. If the arrays are linear or matrix, deployment of the filter elements is by linear motion, as opposed to the rotational motion used by the radial arrays. Deployment of the radial filters is described below in the "Operation of the Invention" section.

Referring again to FIG. 4A, the filter assembly 18 is centered around the optic path. The optical filters 180 are oriented perpendicular to the longitudinal axis of the optic path. The filter assembly 18 will generally comprise a cyan filter 181, a magenta filter 182, a yellow filter 183, and a black filter 184. The ordering of the optic filters makes no difference to the operation of the device. Further, the filter material could be of any type of dichroic, pigmented glass, pigmented plastic, or any other type of light filter.

The black filter 184 would preferably be of a material or type that reflects and/or absorbs only the visible spectrum of light. An example of a reflecting filter is a thin film interference type filter. Filters of this type would reflect nearly all the visible light and transmit nearly all of the infrared energy. Examples of materials that transmit infrared energy and block visible light are silicone, gallium arsenide, and cadmium telluride. The advantage of not absorbing the infrared spectrum of energy is that less heat is contained inside the system or reflected back to the light source.

For low power applications the black filter 184 could absorb or reflect visible and infrared energies. Steel or aluminum are materials suitable for this type of filter.

If the user has an application requiring the generation of only one specific color, a single filter may be employed rather than the filter assembly 18 as disclosed. Other filter types may be employed in the filter assembly 18 as well. Examples of other types of light filters that may be employed are: red, green, and blue filters; diffusion filters (see Applicant's co-pending application, filed on an even date herewith); ultraviolet transmitting filters; polarizing filters; and color correction filters.

Figure 5:
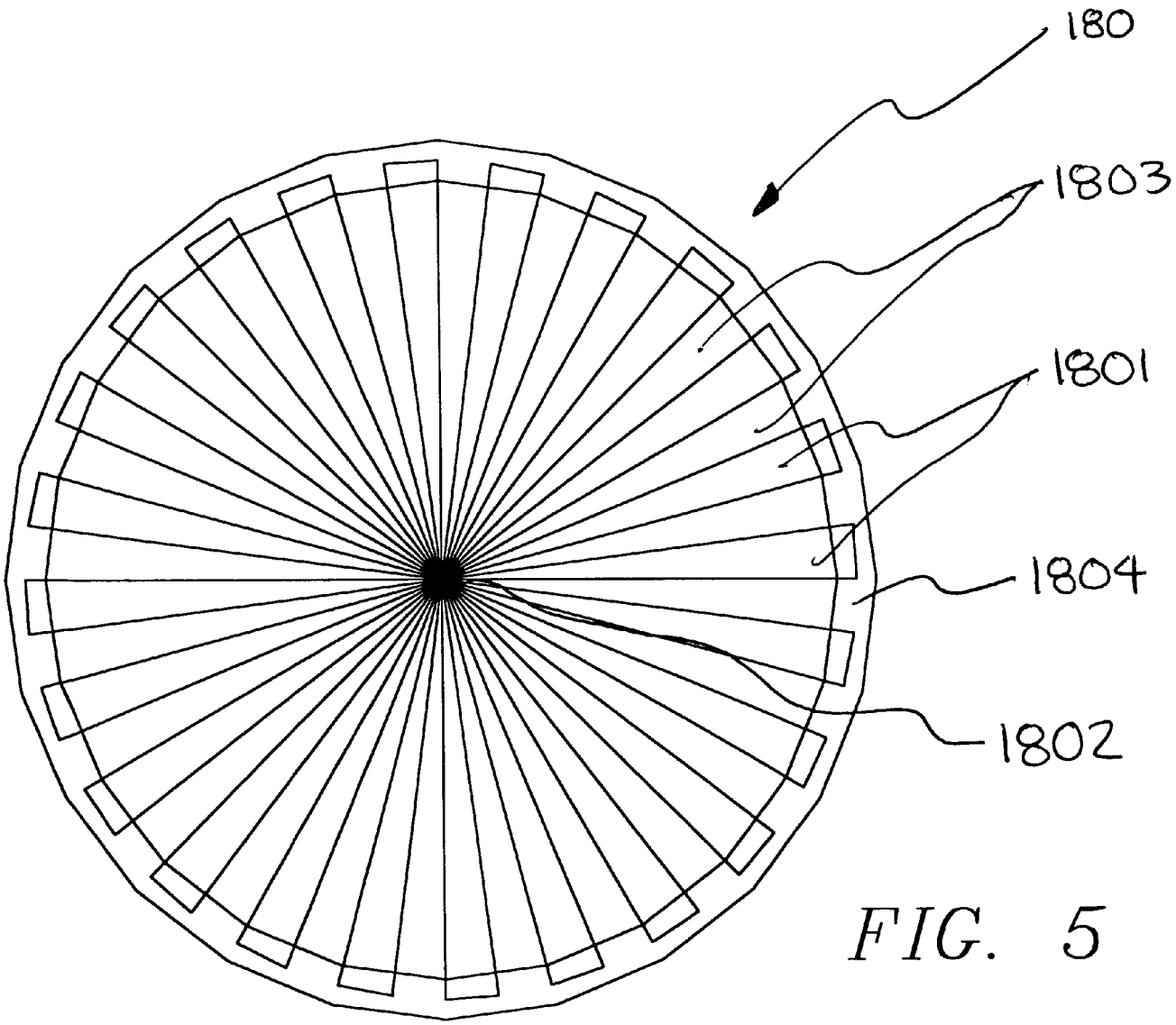
FIG. 5 shows a detail view of the filter element assembly as viewed along the optical axis.
Figure 6A:
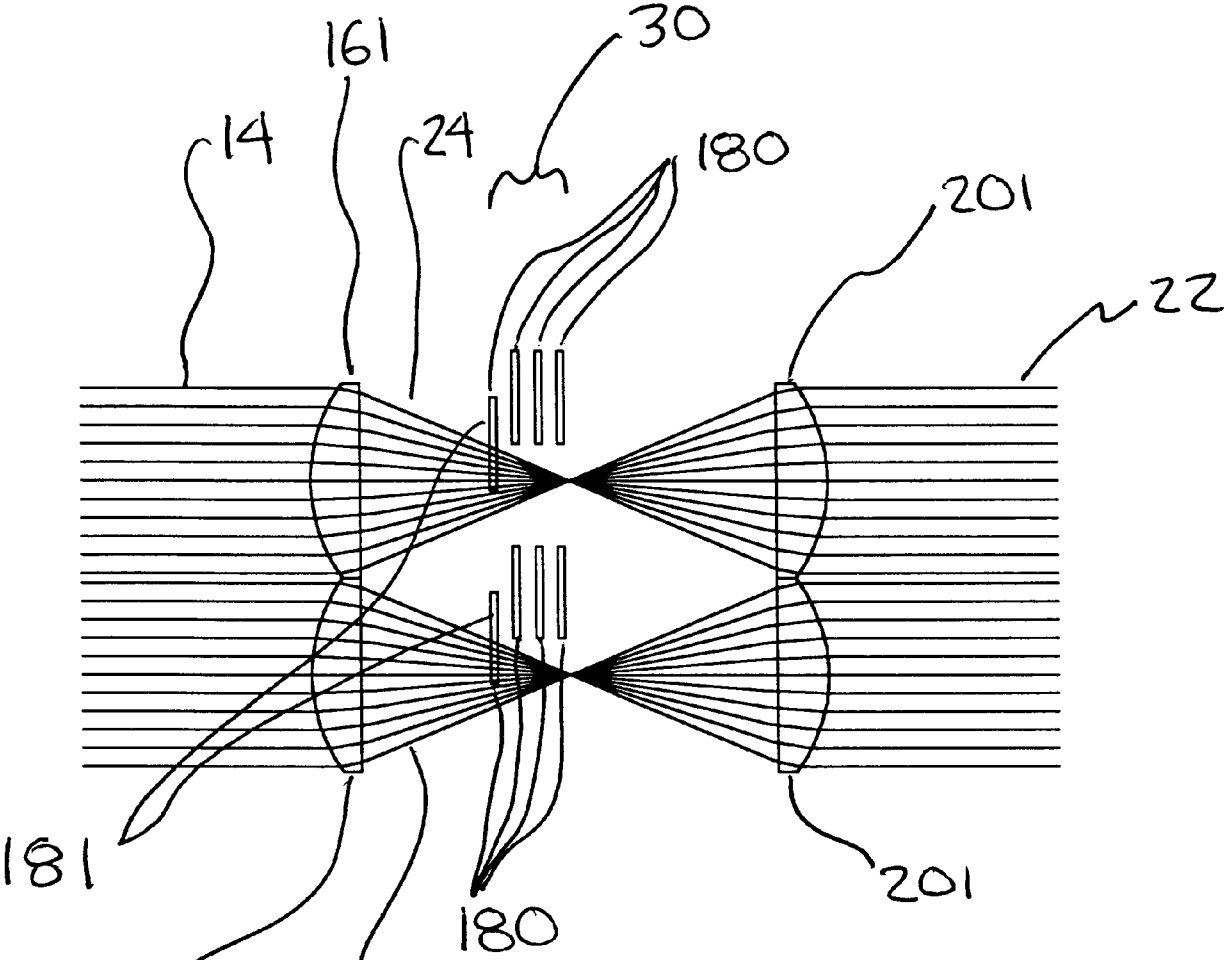
FIG. 6A shows a segment of the optical ray trace of the single lens system with a filter deployed.
Figure 6B:
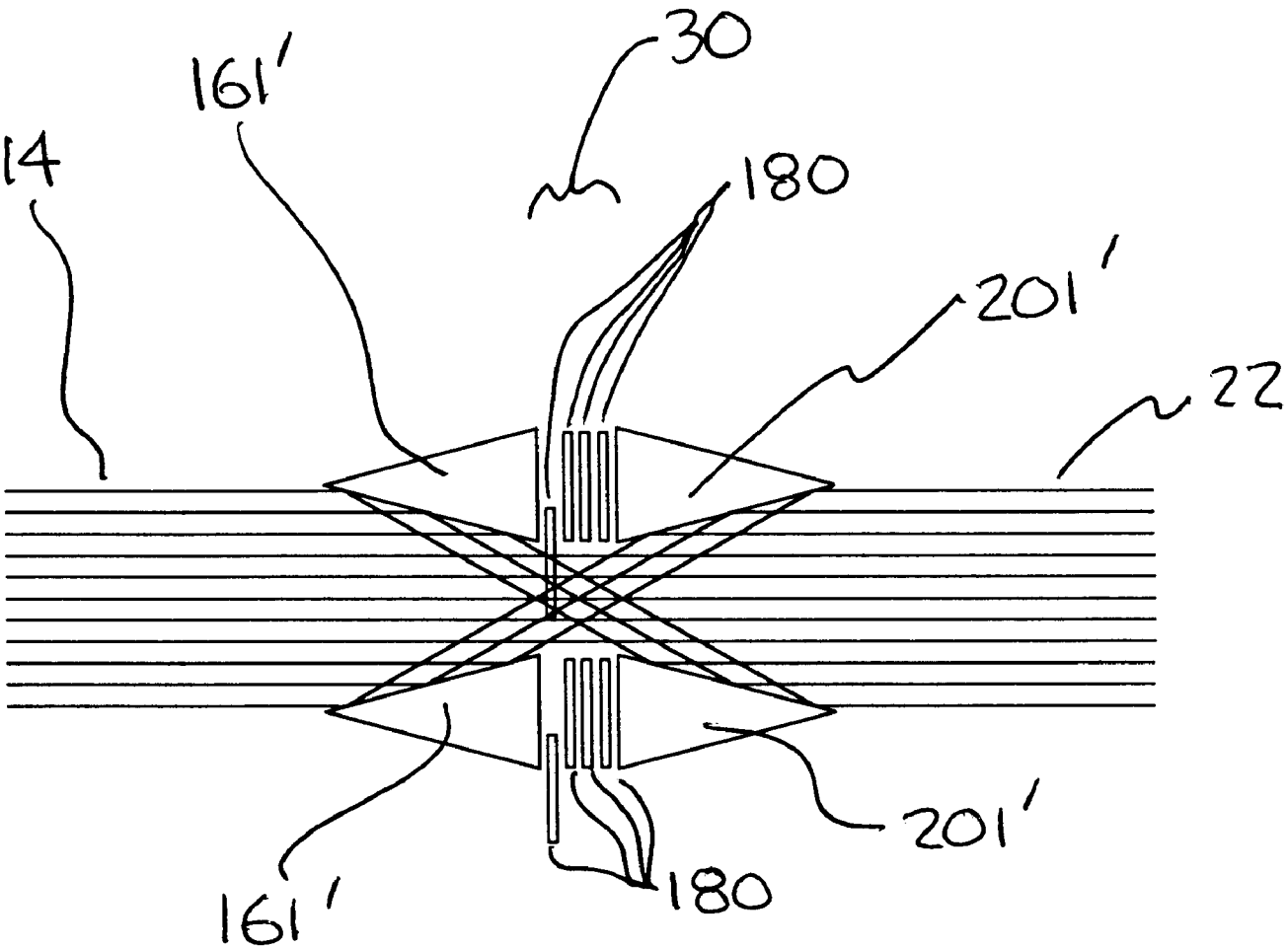
FIG. 6B shows a segment of the optical ray trace of the two reflective element system with a filter deployed.
Figure 6C:
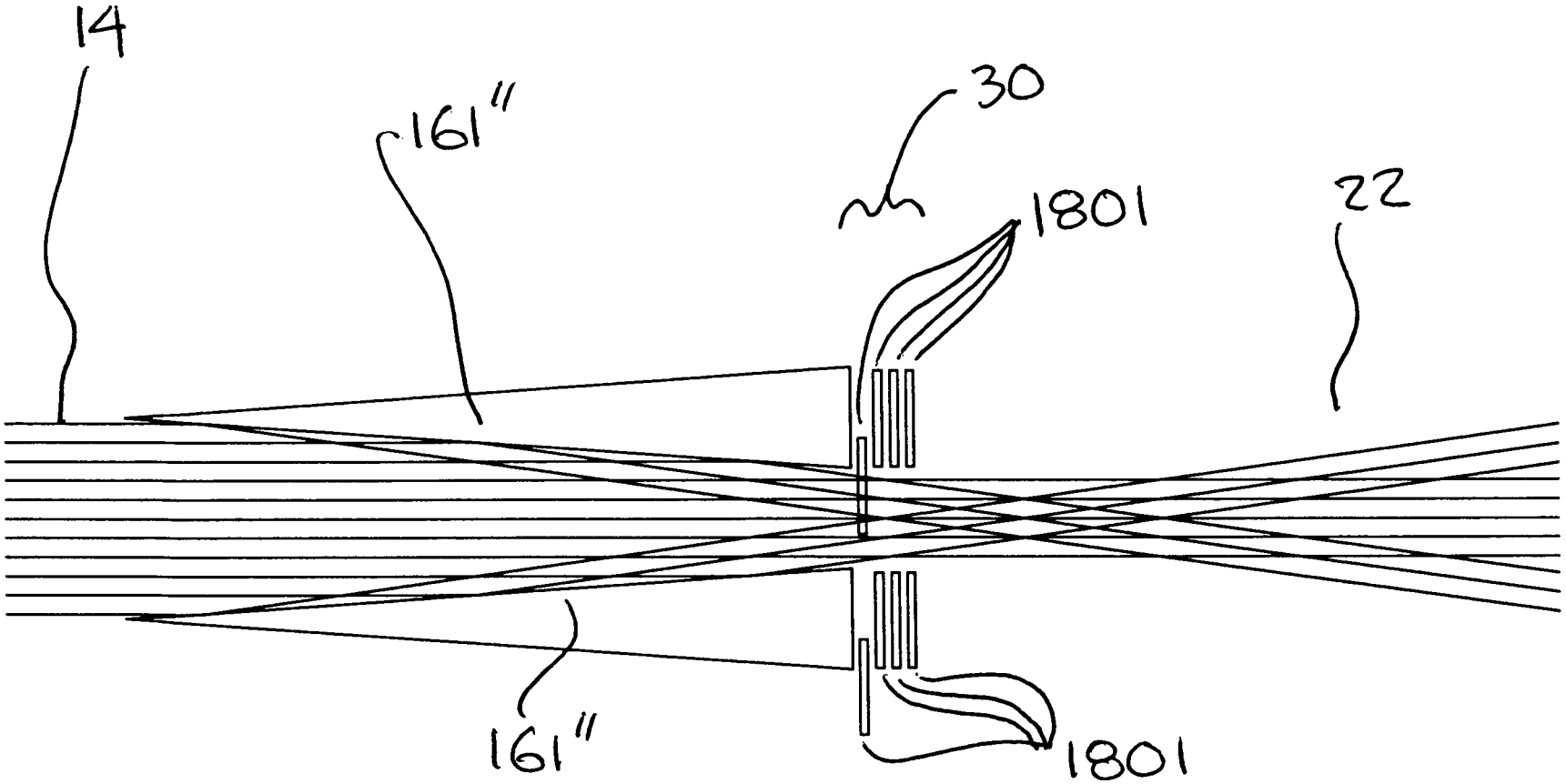
FIG. 6C shows a segment of the optical ray trace of the one reflective element system with a filter deployed.
Figure 6D:
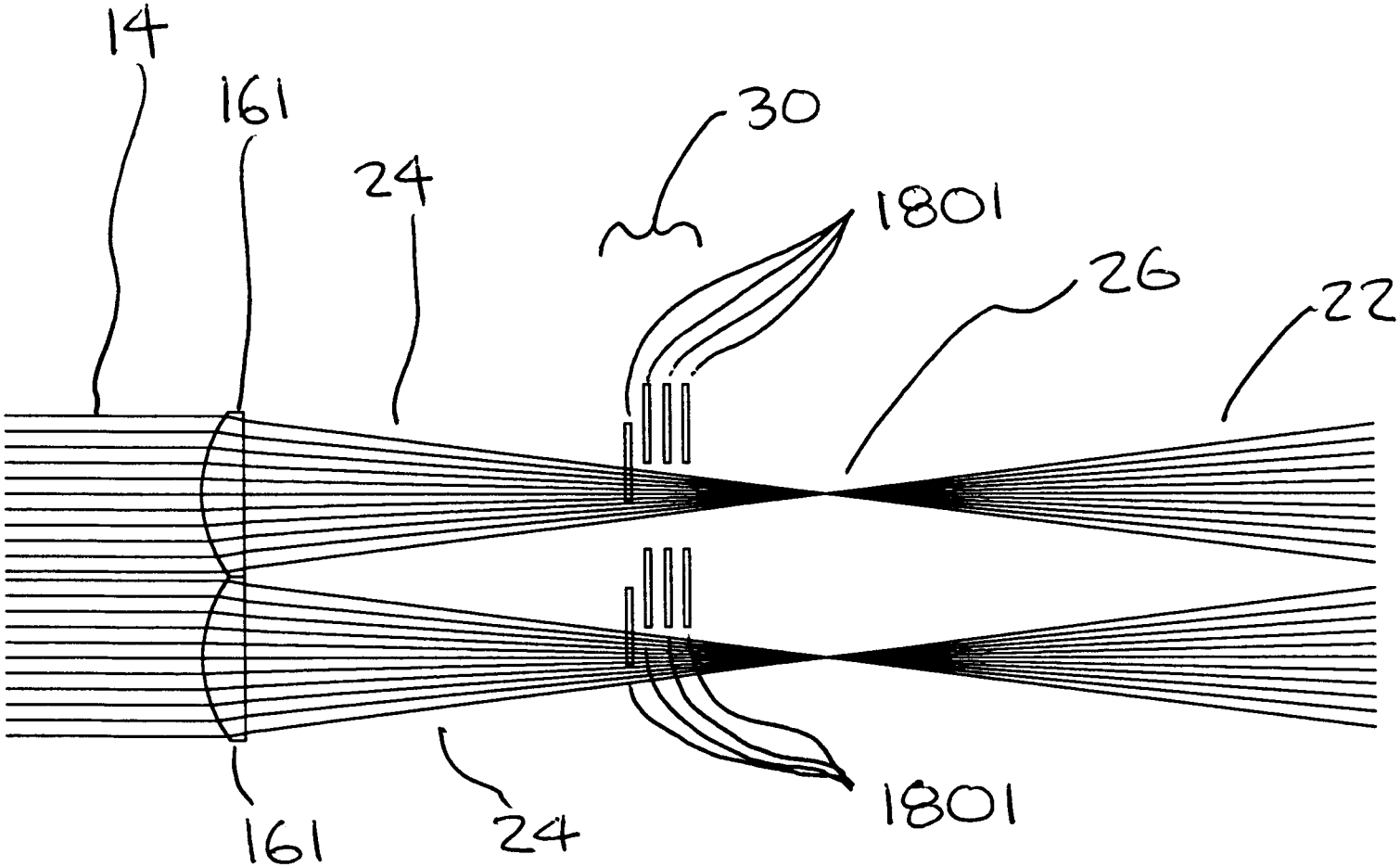
FIG. 6D shows a segment of the optical ray trace of the two lens system with a filter deployed.

FIG. 5 shows a filter 180 that is employed in the filter assembly 18 as the filter 180 is viewed along the optical axis. The construction is typical of any one of the multiple filters that can be utilized. A typical filter segment 1801 is wedge shaped and is radially located about the center 1802 of the filter 180. The multiple wedge shaped filter segments 1801 are attached to a frame 1804. The filter segments 1801 are separated by unfiltered areas 1803. The areas 1803 may be either areas of clear material or areas void of any material. The number of filter segments 1801 utilized is equal to the number of lens segments utilized in the optical elements. The centers of all the filters used and all the optical elements employed are coaxial. The line containing those centers defines the center line of the optic path in the device. The frame 1804 is constrained to rotate about the center 1802 of the filter element 180. Any number of methods can be chosen to constrain the filter 180 to this type of motion. Rotational movement of any of the filters 180 about the optical axis results in the filter interrupting the light.

OPERATION OF THE INVENTION

Referring now to FIGS. 4A–D, when the filters 180 are in the non-deployed position, the center lines of the filter segments 1801 are aligned between the focal lines or the open spaces of the primary optical element 16, 16', 16". When the filters 180 are to be deployed, they are rotated so that the filter segments 1801 begin to intersect the refracted or reflected light rays from the lens or reflective segments of the primary optical element 16, 16', 16". Again, if linear or matrix arrays are utilized, the movement of the filters 180 into the light path would be linear movement as opposed to rotational.

In FIGS. 6A–D, the cyan filter 181 has been rotated so that a filter segment 1801 of the cyan filter 181 begins to impinge on the light region. In all the embodiments, the filter assembly 18 is placed in the optic path in an area 30 where the lens or reflective segments 161, 161', 161" have reduced the cross section of the light regions by refracting or reflecting the light passing through each segment. Thus the rotation of one of the filters 180 causes the filter segment to affect the light. If more effect from the filter is desired, the filter is rotated further so that the filter segment 1801 is completely in the light path. All the filters 180 in the filter assembly 18 are deploy d in this manner. Again, the lens segments of the primary optical elements breaking the light into multiple regions of reduced cross section is what allows this unique deployment of the filters 180. The filters 180 are invisible to the light until the filters 180 are rotated within the light path. The quantity of light filtered is therefore related to the degree of rotation of the filter.

In order to produce red, green, or blue light, at least two of the filters 180 are deployed simultaneously. Partial deployment of one or more of the filters 180 creates different hues and/or saturation of colors. Introducing the black filter 184 into the reduced area 30 controls the intensity of the light transmitted though the device. By altering combinations of the four filters 181, 182, 183, 184, any saturation, hue or intensity of color can be created by the user.

The movement of the filters 180 in and out of the reduced area can be done manually, or it can be controlled by a motor or solenoid utilizing remote or computer control. An individual knowledgeable in the art of motor or solenoid control could devise numerous ways to control the deployment of the filters 180.

Figure 7:
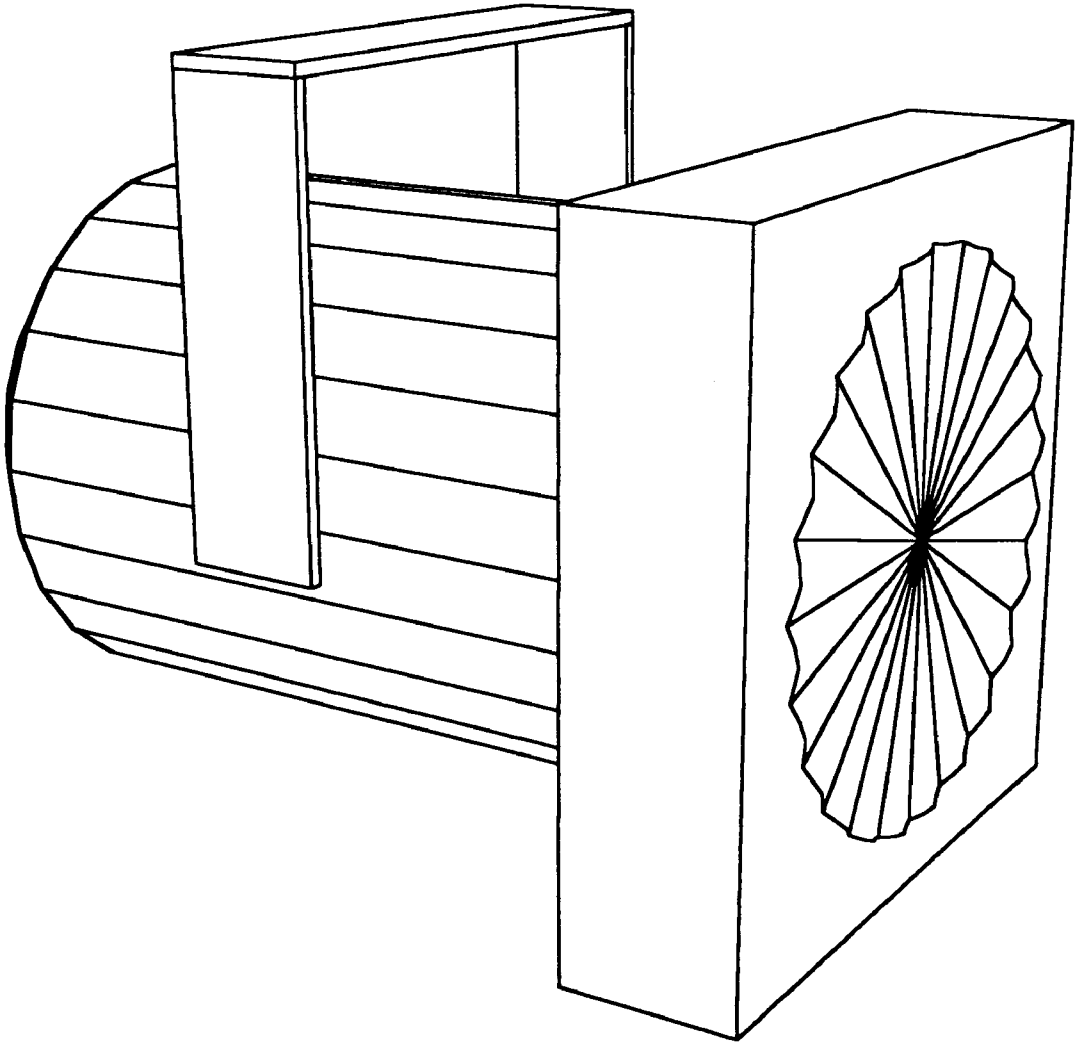
FIG. 7 illustrates a device constructed according to the present invention.
Figure 8:
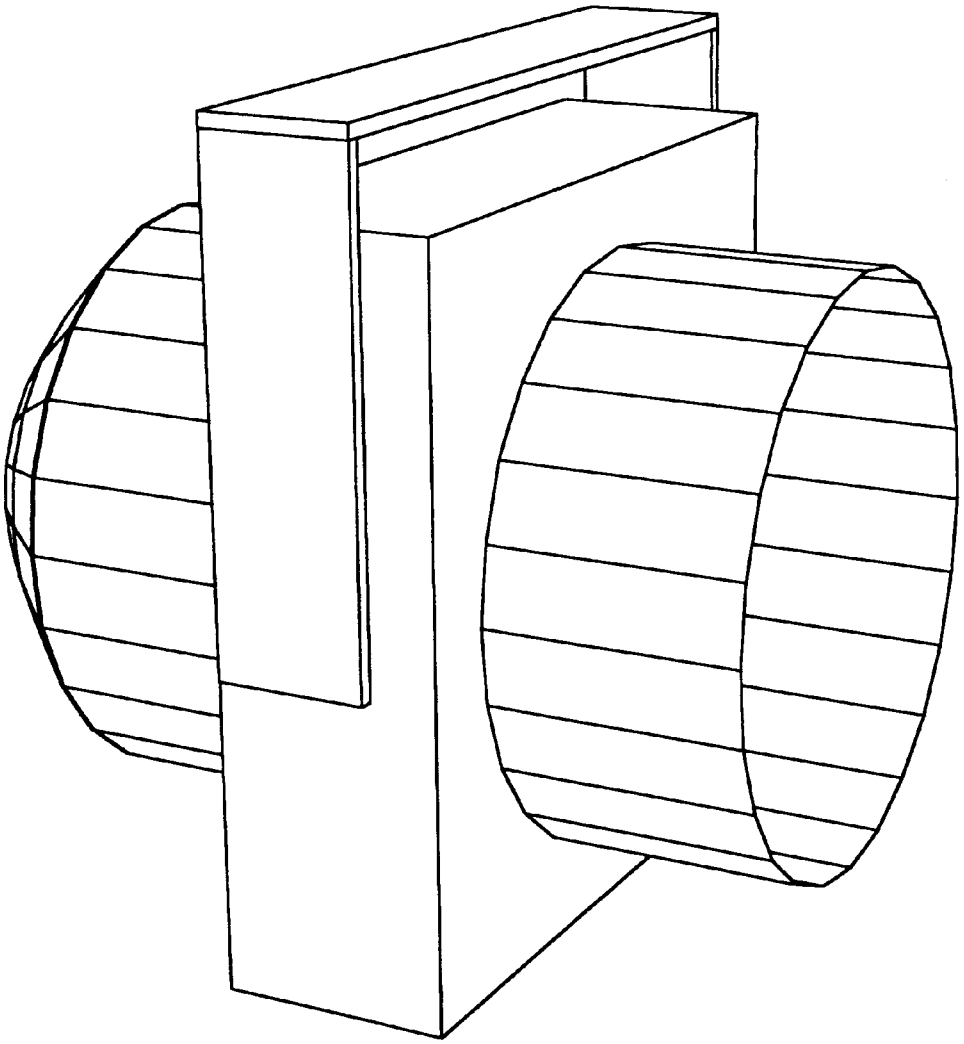
FIG. 8 illustrates another device constructed according to the present invention.

The color filter module of the present invention can be easily added to an existing conventional lighting fixture, as is depicted in FIG. 7. The color filter module of the present invention can also be constructed with the color filter assembly being incorporated in the manufacture of the lighting fixture, as illustrated in FIG. 8.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A device to project various colors, hues, and intensities of light comprising:

a light source that generates generally parallel light along an optic path, a primary optical element comprising an array of optical segments to create an area in said optic path where said light from said light source is divided into a plurality of light regions, each said light region is reduced in area after passing through said optical segment, and a filter means comprising at least one filter, each said filter comprises an array of filter segments, said filter means is located in said optic path past said primary optical means; wherein said filter means is deployed by moving said filter means from a non-deployed position in which said filter segments do not impinge said light regions to a deployed position in which said filter segments impinge said light regions, and an effect of said filter is controlled in degree by controlling an amount of impingement of said filter segments on said light regions.

2. The light projecting device of claim 1 wherein:

said array of optical segments of said primary optical element is a radial array.

3. The light projecting device of claim 1 wherein:

said array of filter segments of said filter means is a radial array.

4. The light projecting device of claim 1 wherein:

said array of optical segments of said primary optical element is a linear array.

5. The light projecting device of claim 1 wherein:

said array of filter segments of said filter means is a linear array.

6. The light projecting device of claim 1 wherein:

said array of optical segments of said primary optical element is a matrix array.

7. The light projecting device of claim 1 wherein:

said array of filter segments of said filter means is a matrix array.

8. The light projecting device of claim 1 wherein:

the number of said optical segments equals the number of said filter segments.

9. The light projecting device of claim 1 wherein:

a secondary optical element is installed in said optic path after said filter means to redirect said light so that light projected from said device has a projected direction substantially the same as a projected direction of the light directed at said primary optical element.

10. The light projecting device of claim 1 wherein:

said primary optical element comprises refractive lens segments.

11. The light projecting device of claim 1 wherein:

said primary optical element comprises reflective segments.

12. The light projecting device of claim 1 wherein:

said filter means comprises a plurality of filters, each of said filters having different optical properties.

13. The light projecting device of claim 12 wherein:

at least one of said filters is a visible light blocking filter that allows infrared light to pass, thereby enabling a user to control the intensity of projected light.

14. The light projecting device of claim 12 wherein:

at least one of said filters is an interference filter.

15. The light projecting device of claim 12 wherein:

at least one of said filters is formed from absorptive material.

16. The light projecting device of claim 12 wherein:

at least one of said filters is a dichroic filter.

17. A device to project various intensities of light comprising:

a light source that generates generally parallel light along an optic path, and a filter means comprising a visible light blocking filter that allows infrared light to pass, said filter comprises an array of filter segments, said filter means is located in said optic path past; wherein said filter means is concentric with said optic path, and said filter means is deployed by rotating said filter means about a longitudinal axis of said optic path from a non-deployed position in which said filter segments do not impinge said generally parallel light to a deployed position in which said filter segments impinge said generally parallel light, and an effect of said filter is controlled in degree by controlling an amount of impingement of said filter segments on said generally parallel light.

18. The light projecting device of claim 17 wherein:

said array of filter segments of said filter means is a radial array.

19. The light projecting device of claim 17 wherein:

said array of filter segments of said filter means is a linear array.

20. The light projecting device of claim 17 wherein:

said array of filter segments of said filter means is a matrix array.

* * * * *